US012325958B2

(12) United States Patent
Seleenmary Sobhanadhas et al.

(10) Patent No.: US 12,325,958 B2
(45) Date of Patent: Jun. 10, 2025

(54) METHOD FOR MAKING MOISTURE-RESISTANT PAPER

(71) Applicant: METGEN OY, Kaarina (FI)

(72) Inventors: Liji Sobhana Seleenmary Sobhanadhas, Turku (FI); Tom Christian Lundin, Turku (FI); Antoine Patrice Noël Mialon, Turku (FI); Tanja Pauliina Saloranta, Paimio (FI)

(73) Assignee: METGEN OY, Kaarina (FI)

( * ) Notice: Subject to any disclaimer, the term of this patent is extended or adjusted under 35 U.S.C. 154(b) by 130 days.

(21) Appl. No.: 17/912,651

(22) PCT Filed: Mar. 22, 2021

(86) PCT No.: PCT/EP2021/057172
§ 371 (c)(1),
(2) Date: Sep. 19, 2022

(87) PCT Pub. No.: WO2021/191097
PCT Pub. Date: Sep. 30, 2021

(65) Prior Publication Data

US 2023/0133654 A1 May 4, 2023

(30) Foreign Application Priority Data

Mar. 26, 2020 (EP) ..... 20165925

(51) Int. Cl.
*D21H 17/23* (2006.01)
*D21H 17/00* (2006.01)
(Continued)

(52) U.S. Cl.
CPC ..... *D21H 17/23* (2013.01); *D21H 17/005* (2013.01); *D21H 17/15* (2013.01); *D21H 21/16* (2013.01); *D21H 21/18* (2013.01)

(58) Field of Classification Search
CPC ..... D21H 17/23; D21H 17/005; D21H 17/15; D21H 21/16; D21H 21/18; D21H 19/34
See application file for complete search history.

(56) References Cited

U.S. PATENT DOCUMENTS 6,228,217 B1 * 5/2001 Dickerson ..... D21H 17/42 162/168.3
2001/0009955 A1 7/2001 Huttermann et al.
(Continued)

FOREIGN PATENT DOCUMENTS

EP 0433258 A1 6/1991
WO 2006121634 A2 11/2006
(Continued)

OTHER PUBLICATIONS

Veera Hamalainen et al: "Enzymatic Processes to Unlock the Lignin Value" • Frontiers in Bioengineering and Biotechnology. vol. 6. Mar. 22, 2018 (Mar. 22, 2018). XP055556662. DOI: 10.3389/fbioe.2018.00020.

*Primary Examiner* — Jacob T Minskey
*Assistant Examiner* — Elisa H Vera
(74) *Attorney, Agent, or Firm* — Tyler Sisk; Casimir Jones SC

(57) ABSTRACT

The invention is in the field of papermaking. It provides methods for improving the compressive strength of paper and board by improving the moisture resistance of paper and board. The invention also provides paper and board with an improved compressive strength as well as a composition for improving the compressive strength of paper and board. More in particular, the invention relates to a process for the manufacture of paper wherein the process comprises a wet phase and a dry phase, wherein an enzymatically oxidized lignin is added in the wet phase.

10 Claims, 2 Drawing Sheets

(51) Int. Cl.

| | |
|---|---|
| ***D21H 17/15*** | (2006.01) |
| ***D21H 21/16*** | (2006.01) |
| ***D21H 21/18*** | (2006.01) |

(56) References Cited

U.S. PATENT DOCUMENTS

| | | | | |
|---|---|---|---|---|
| 2001/0054491 | A1* | 12/2001 | Malmstrom | D21H 17/17<br>162/181.2 |
| 2019/0100875 | A1* | 4/2019 | Harrington | D21H 21/10 |
| 2022/0251784 | A1* | 8/2022 | Gorur | D21H 25/02 |

FOREIGN PATENT DOCUMENTS

| | | | |
|---|---|---|---|
| WO | 2006121634 | A3 | 12/2007 |
| WO | 2008027501 | A2 | 3/2008 |
| WO | 2008027501 | A3 | 8/2008 |
| WO | 2013182751 | A1 | 12/2013 |
| WO | 2017102540 | A1 | 6/2017 |
| WO | 2018019707 | A1 | 2/2018 |
| WO | 2018146341 | A1 | 8/2018 |

* cited by examiner

METHOD FOR MAKING MOISTURE-RESISTANT PAPER

CROSS REFERENCE TO RELATED APPLICATIONS

This application is a national stage application of PCT/EP2021/057172 filed Mar. 22, 2021, which claims priority to European Application No. 20165925.7 filed Mar. 26, 2020, each of which are hereby incorporated by reference in their entirety.

FIELD OF THE INVENTION

The invention is in the field of papermaking. It provides methods for producing paper and board with an increased compressive strength by increasing the moisture resistance of paper and board. The invention also provides paper and board with an increased compressive strength as well as a composition for increasing the compressive strength of paper and board.

BACKGROUND OF THE INVENTION

Cellulose-based sheets like paper, board and the like, such as cardboard and corrugated board are the most widely used type of material for the packaging and distribution of a wide variety of commodities ranging from fruits and vegetables, consumer products to industrial items. It is suitable for all the different modes of storage and transport such as shipping by sea or by air. The most important feature of containers made from paper, board or the like, such as cardboard or corrugated board or corrugated cardboard is to protect the packaged commodities against damage during storage and transport. Therefore, the maintenance of strength of the packaging material during storing, marketing and distribution of packed products is essential.

For example, the storage and transport of agricultural products is usually carried out in a low temperature and/or high humidity environment. Recommended relative humidity (RH) level for the storage of fresh fruit and vegetables is commodity specific; however, levels are generally in the range of 85-95% (Paull R. E. Postharvest Biol. Technol. (1999) 15:263-277; Rennie et al., Colinf and storage in Handbook of postharvest technology; Marcel Dekker (2003) 505-520; Maguire et al; Handbook of vegetable preservation and processing; Marcel Dekker (2004) 1-28).

One of the problems occurring when moisture-absorbing material, such as paper, cardboard or corrugated cardboard is used for the packaging of agricultural products, is that its strength gradually decreases when stored under humid conditions (Navaranjan, N. et al. Composites: Part B 45 (2013) 965-971). The reduction in strength of packaging material can lead to collapse of the package, thereby causing mechanical damage to products. Furthermore, wetting may result in deterioration by microorganisms of the packaging material. Various studies have been performed on corrugated cardboard and its resistance against moisture resulting in a loss of compressive strength. They found that corrugated cardboard is very sensitive material to the environmental conditions, especially high relative humidity. Once wet or moist, paper, board and corrugated cardboard lose their rigidity. Modzelewska (Folia Forestalia Polonica 2006; 37: 33-45) indicated that when the relative humidity (RH) of ambient air was about 100%, boxes made from corrugated cardboards practically disintegrated.

One solution that has been proposed for solving this problem is to use mists with nano-sized droplets to raise the humidity of storage environments (Duong Van Hung et al., Composite Science and Technology 70 (2010) 2123-2127). It is reported by Barrow and Pope (Appl. Energy (2007) 84: 404-412) that the evaporation rate is greater with smaller droplets because small droplets have greater surface area relative to their volume (surface area to mass ratio) as compared with larger droplets.

It has also been proposed to coat a paper surface with polymers, such as aluminum or petroleum-based polymers. However, the use of fossil fuel based coatings poses an ecological problem. Therefore, from an ecological point of view, it would be advantageous to replace fossil fuel materials with biobased polymers (Andersson (2008) Packaging technology and Science 21(6): 339-373).

Several biopolymers were tested for this purpose such as cellulose (Park & Chinnan (1995) J. Food Engineering 25(4), 497-507), chitosan (Wiles, Vergano, Barron, Bunn, & Testin (2000) J. Food Science 65(7) 1175-1179), microfibrillated cellulose (Aulin, Gällstedt, & LindstrÖm, (2010) Cellulose 17(3), 559-574), and starch (Garcia, Martino, & Zaritzky, (1999) Scanning, 21(5); 348-353). The problem with these materials however, is their hydrophilic character which prompts fractional losses of their obstruction properties in high humidity environments (Hansen & Plackett, (2008) Biomacromolecules 9(6); 1493-1505).

It has recently been proposed to use lignin-based coatings for making paper more resistant to high humidity. Lignin is mainly hydrophobic and it has been shown that lignin improved the water-resistance of biobased composites (Baumberger, (2002) Springer 978-1-4613-5173-3 pp 1-19) and improved its gas-barrier properties (VVu, Wang, Li, Li, & Wang, (2009) Bioresource technology, 100(9); 2569-2574 and US 2001/009955 A1).

However, lignin has poor film forming properties. It has therefore been proposed to alter some of the functional groups of lignin. Chemical functionalization appeared to improve its thermoplastic properties as demonstrated by the esterification of hydroxyl groups in lignin with fatty acids (Funakoshi et al., (1979) Holzforschung—International Journal of the Biology, Chemistry, Physics and Technology of Wood 33(5); 159-166). Furthermore, lignin esters with stearate are excellent compatibilizers and lubricants (Nadji et al., (2009) J. Applied Polymer Science, 114(5); 3003-3007). Lignin esters remain useful as a coating material for paperboard by enhancing barrier properties with regard to oxygen and water vapor (Hutt, Ropponen, Poppius-Levlin, Ohra-Aho, & Tamminen, (2013) Industrial Crops and Products 50; 694-700; Poppius-Levlin, Hult, Ropponen, Hohenthal, & Tamminen (2012) Proceedings of the $4^{th}$ Nordic wood biorefinery conference Helsinki, Finland).

Esterified lignin coatings as oxygen and water vapor barriers for fiber-based packaging were studied by Hult, Koivu, et al. ((2013) Holzforschung 67(8); 899-905). In this study, palmitic acid and lauric acid were covalently linked to commercially available hardwood Kraft lignin as well as to softwood Kraft lignin by means of esterification. The resulting lignin esters were applied to paperboard with a bar coater and the barrier properties in terms of the oxygen transmission rate (OTR) and water vapor transmission rate (WVTR) were recorded. The researchers concluded that the modified-lignin coated paperboards showed significantly improved barrier properties with regard to OTR and WVTR compared to untreated paperboards.

The development of coatings based on lignin palmitates as sustainable alternatives to petroleum-based barrier materials is however hampered by the fact that fatty acids are rather expensive and the price of lignin esterified to fatty acids becomes prohibitive for most industrial uses. Also, the moisture resistance of paper coated with either lignin alone or in combination with fatty acids leaves to be desired.

Patent application EP 3561177 A1 describes the use of depolymerized lignin together with an aluminum salt as an additive in the papermaking process in order to increase the hydrophobicity of the resulting paper.

Despite these advances, there remains a need of improved methods for preparing paper with a high compression strength.

SUMMARY OF THE INVENTION

The invention relates to a process for the manufacture of paper wherein the process comprises a wet phase and a dry phase, wherein the wet phase comprises the steps of preparing a fibrous slurry comprising fibers in water, forming a fibrous web from the fibrous slurry by selectively removing the water, thereby obtaining a fibrous web containing 20 to 90 mass % of water, and wherein the dry phase comprises a step of drying the fibrous web to obtain a paper sheet comprising less than 20 mass % of water, wherein an additive is added during the wet phase, characterized in that the additive comprises enzymatically oxidized lignin.

The invention also relates to paper obtainable by the process as described herein, characterised in that the paper comprises enzymatically oxidized lignin and has a compression index above 25 Nm/g.

The invention also relates to a composition comprising enzymatically oxidized lignin, depleted of lignin with a molecular weight below 2 kDa, preferably below 5 kDa, such as 10 kDa, 20 kDa, 50 kDa or 70 kDa as well as the use of such a composition as an additive in a papermaking process for increasing the compressive strength of paper obtained in said papermaking process.

DETAILED DESCRIPTION OF THE INVENTION

Figure 1:
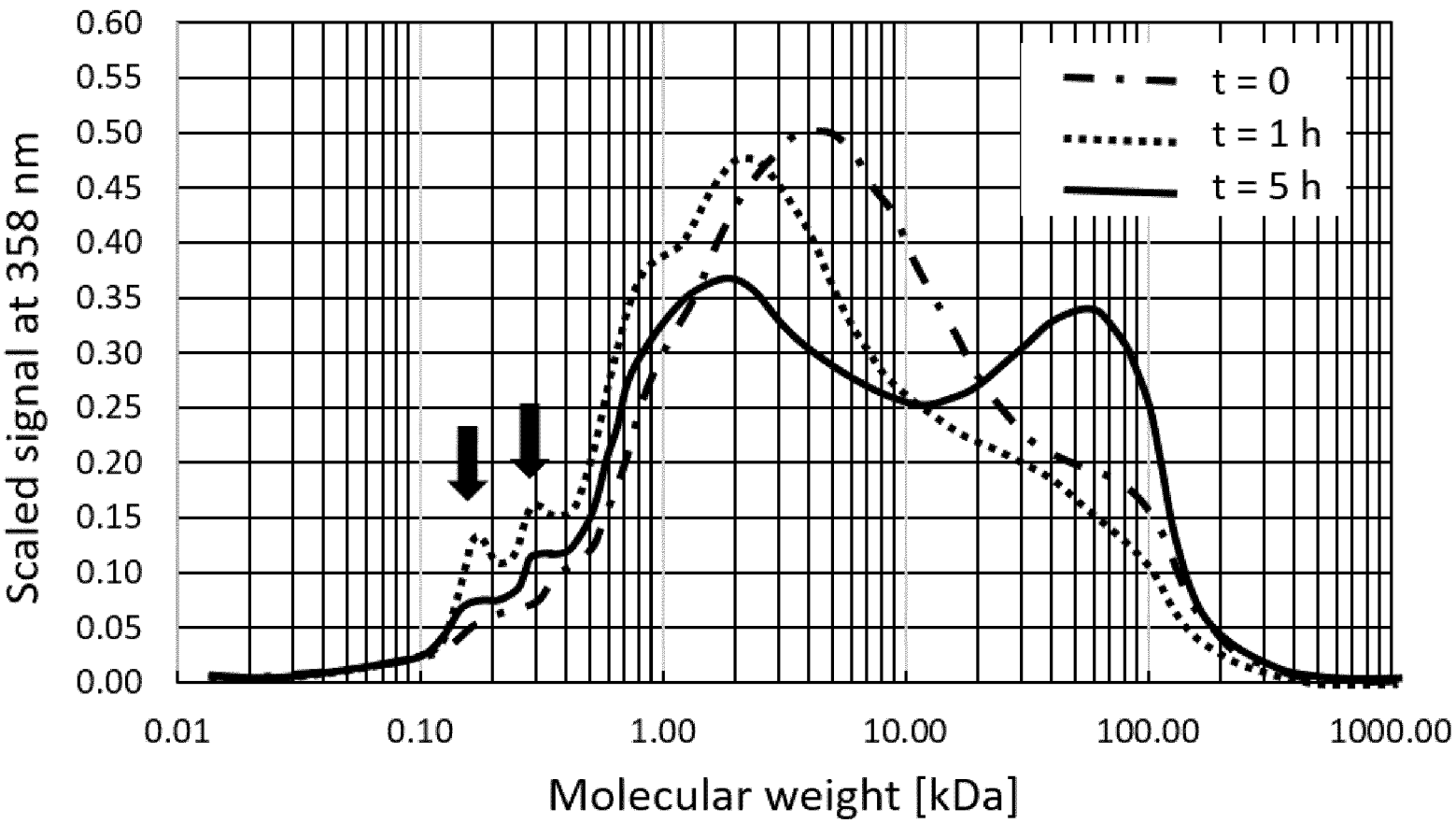
FIG. 1 depicts relative absorption at 358 nm plotted against molecular weighty (log scale) for lignin prior to enzymatic oxidation (t=0), or after 1 hour or 5 hour of enzymatic oxidation.

The technology of papermaking addresses the methods, equipment, and materials used to make paper, board and the like, such as cardboard and corrugated board and corrugated cardboard. The project leading to this application has received funding from the Bio Based Industries Joint Undertaking (JU) under grant agreement No 792061. The JU receives support from the European Union's Horizon 2020 research and innovation programme and the Bio Based Industries Consortium.

In the art there is no clear distinction between paper and board. In the literature, the definition of the term paperboard varies. According to the ISO standardization body, a paper product with a grammage exceeding 200 g/m$^2$ is called paperboard; however the definition by the Confederation of European Paper Industries, CEPI, reads "paper is usually called board when it is heavier than 220 g/m$^2$". The terms "paper" and "board" are used interchangeably herein. The term "grammage" indicates the dry weight of a paper or fabric product, per unit of area expressed in grams per square meter (g/m$^2$). The term "dry weight" as used herein indicates the weight of all solid components of the paper sheet excluding water. In the art, the term "bone dry" is also used to indicate the dry weight of a material.

Paperboard or board can be made in a single ply or, more commonly, in several plies (multi-ply). For quality reasons paperboard usually requires a combination of several layers of fiber in the wet state. When studying the traditional paperboard market one can see that multi-ply paperboard is already made at 160 g/m$^2$. In the literature, two features are often used to distinguish paperboard from paper; paperboard contains a greater proportion of long fiber than paper and paperboard does not normally contain fillers.

A "fiber" is a natural or synthetic structure that is significantly longer than it is wide. Fibers are often used in the manufacture of other materials. The use of cellulose fibers or lignocellulose fibers is well-known in the art of papermaking.

Paper is used widely for printing, writing, and packaging, among many other purposes and useful products. Today almost all paper is manufactured using industrial machinery, while handmade paper survives as a specialized craft and a medium for artistic expression.

In a representative example of an industrial papermaking process, a dilute suspension consisting mostly of separate fibers such as cellulose fibers or lignocellulose fibers in a liquid carrier medium such as water is drained through a sieve-like screen, so that a web of randomly interwoven fibers is laid down forming a fibrous web also called a fibrous wet web. Liquid is then further removed from this fibrous wet web by pressing, sometimes aided by suction or vacuum. In a final step the paper is then dried, usually by heating. Once dry, a generally flat, uniform and strong sheet of paper is obtained.

In more detail, papermaking involves making a dilute suspension of fibers in liquid, such as water, called "furnish" or "slurry", and removing at least part of the water, for instance by forcing this suspension to drain through a screen, thereby creating a web of interwoven fibers. Water is removed from this web of fibers for instance by using a press.

As used herein, the term "slurry" refers to a mixture of solids suspended in liquid, usually water.

The method of manual papermaking has changed very little over time, despite advances in technologies. The process of manufacturing handmade paper can be generalized into several distinctive steps: Separating the useful fiber from the rest of raw materials, (e.g. cellulose and lignocellulose from wood, cotton, etc.), processing the fiber into pulp, optionally adjusting the color, mechanical properties, chemical and biological properties and other properties of the paper by adding special chemical premixes, screening the resulting slurry, and pressing and drying to get the actual paper.

The term "screening" in this context is used as a process wherein fibers in water are drained through a sieve-like screen so that a mat or web of randomly interwoven fibers is obtained.

Screening the fiber may involve using a mesh made from non-corroding and inert material, such as brass, stainless steel or a synthetic fiber, which is stretched in a paper mold, a wooden frame similar to that of a window. The size of the paper is governed by the open area of the frame. The mold may then be completely submerged in the furnish, then pulled, shaken and drained, forming a uniform layer on the screen. Excess water is then removed, the wet web of fiber laid on top of a damp cloth or felt in a process called "couching". The process is repeated for the required number of sheets. Excess water from this stack of wet webs is then further removed, for instance by pressing in a hydraulic press. The fairly damp fiber may then be dried using a variety of methods, such as vacuum drying or simply air drying. Sometimes, the individual sheet is rolled to flatten, harden, and refine the surface. Finally, the paper is then cut to the desired shape or the standard shape (A4, letter, legal, etc.) and packed.

As used herein, the term "Pulp" refers to a composition comprising lignocellulosic fibrous material prepared by chemically or mechanically separating cellulose fibers from biomass, such as wood, fiber crops or waste paper. The timber resources used to make wood pulp are referred to as pulpwood. Wood pulp comes from softwood trees such as spruce, pine, fir, larch and hemlock, and hardwoods such as *eucalyptus*, aspen and birch.

A pulp mill is a manufacturing facility that converts wood chips or fibers from other sources into a pulp of fibers that can be dried, baled and shipped to a paper mill for further processing. Alternatively, paper or board manufacturing facilities may be integrated and never-dried pulp can be used directly for paper production.

Pulp is a suspension that is characterized by its ability to absorb and retain water, which may be quantified as Canadian Standard Freeness (CSF) measured in milliliters. Defibrated wood material can be considered as pulp if its CSF can be determined.

Pulp can be manufactured using mechanical, semi-chemical or fully chemical methods (Kraft and sulfate processes). The finished product may be either bleached or non-bleached, depending on the end-application and customer requirements.

Wood and other plant materials that may be used to make pulp contain three main components (apart from water): cellulose fibers (desired for papermaking), lignin (a three-dimensional polymer that binds the cellulose fibers together) and hemicelluloses, (shorter branched carbohydrate polymers).

The aim of the pulping process is to break down the native bulk structure of the fiber source, be it chips, stems or other plant parts, into the constituent fibers.

Chemical pulping such as Kraft pulping achieves this by chemically degrading the lignin and hemicellulose into smaller, water-soluble molecules which can be washed away from the cellulose fibers without significantly depolymerizing the cellulose fibers. However, this chemical process depolymerizes the hemicellulose and weakens the physical strength of the fibers.

The Kraft process (also known as kraft pulping or sulfate process) is a process for conversion of wood into wood pulp, which consists of almost pure cellulose fibers. The Kraft process entails treatment of wood chips with a hot mixture of water, sodium hydroxide, and sodium sulfide, known as white liquor, which breaks the bonds that link lignin, hemicellulose, and cellulose. The technology entails several steps, both mechanical and chemical. It is the dominant method for producing chemical pulp.

The various mechanical pulping methods, such as groundwood (GW) and refiner mechanical pulping (RMP), physically tear the cellulose fibers one from another. Much of the lignin remains adhered to the fibers. Strength may also be impaired because the fibers may be cut.

There are a number of related hybrid pulping methods that use a combination of chemical and thermal treatment, for instance an abbreviated chemical pulping process, followed immediately by a mechanical treatment to separate the fibers. These hybrid methods include chemi-thermomechanical pulping, also known as CTMP. The chemical and thermal treatments reduce the amount of energy subsequently required by the mechanical treatment, and also reduce the loss of strength suffered by the fibers.

Mechanical pulping of wood is normally an energy intensive process; for example, a typical newsprint pulp may need 2160 kWh of refiner energy per ton of feedstock to refine wood chips into pulp.

Lignin is the second most abundant biopolymer on the earth and a major component of the plant cell wall. Lignin is also a major side-product for several industries, including the paper and pulping industry and the lignocellulosic biorefinery. Due to the recalcitrant nature of the complex polyphenolic structure, the utilization of lignin for the production of biofuels and bioproducts is a major challenge for both biorefineries and paper/pulping industry. As compared to cellulose and hemicellulose, the methods and systems for utilization of lignin are very limited.

An industrial paper mill is divided into several sections, roughly corresponding to the processes involved in making handmade paper. Pulp is prepared, refined and mixed in liquid such as water with other additives to make a pulp slurry. The head-box of the paper machine (Fourdrinier machine) distributes the slurry onto a moving continuous screen, liquid drains from the slurry (for instance by gravity or under vacuum), the wet paper sheet or wet web goes through presses and dries, and finally rolls into large tambour rolls.

Another type of paper machine makes use of a cylinder mold that rotates while partially immersed in a container of dilute pulp. The pulp is picked up by the wire and covers the mold as it rises out of the vat (Clapperton, R. H. (1967) The Paper-Making Machine. Its Invention, Evolution, and Development, Pages 65-77). A couch roller is then usually pressed against the mold to smooth out the pulp, and picks the wet web off the mold. The web is further dewatered by applying a pressure difference.

We now surprisingly found that paper with a high compressive strength can be produced using a method wherein enzymatically oxidized lignin is added at the wet end of a paper manufacturing process, in particular when the enzyme is an alkaline laccase. Using a process according to the invention, a paper with a high compressive strength could surprisingly be obtained. Paper produced in a process according to the invention had a higher compressive strength than paper produced in a conventional method using non-enzymatically oxidized lignin, such as Kraft lignin.

Alkaline laccases and other enzymes for the enzymatic oxidation of lignin are known in the art (WO 2018/019707, WO 2008/027501 and EP 0433258 A1)

As used herein, the term "wet end" refers to a stage in the papermaking process wherein the fibers reside in the slurry or to a stage wherein the fibrous wet web contains 20 to 90 mass % of water. In other words, the fibrous web in this phase contains 10 to 80 mass % of dry matter. Dry matter is defined herein as the relative weight of all components of a material excluding water. Dry weight of a material is the weight of all solid components excluding water. In the art, the term "bone dry" is also used to indicate the dry weight of a material.

The term 20 to 90 mass % is to be understood as encompassing a range of percentages with a lower limit of 20, 25, 30, 35, 40, 50, 60, 70 or even 80% and an upper limit of 90, 85, 80, 75, 70, 65, 60, 55, 50, 40, or even 30%. This depends of the type of papermaking process that is applied. As a general rule, the wet phase ends at a percentage of water content that the paper has when it enters the drying module. In any case, the wet phase starts when the fibers are dissolved in water, which may be at a water content of about 98-99%. For example, the water content of the slurry used to start the papermaking process may be in the order of 98 to almost 100% such as 98 to 99.99%, or between 98.5 and 99.8%. The slurry may also be more concentrated. This depends on the particular requirements of the process, requirements of which the skilled person is well aware.

Conversely, the term "dry end" refers to a stage in the papermaking process wherein the fibrous web contains less than 20 mass % of water, or 80 or more mass % of dry matter.

As described herein, it was found that the compressive strength of paper could be drastically increased and thus improved by adding enzymatically oxidized lignin during the wet phase of the papermaking process.

Compressive strength or compression strength is the capacity of a material or structure to withstand physical deformation by compressive loads, as opposed to tensile strength, which withstands deformation loads tending to elongate the structure. In other words, compressive strength resists compression (being pushed together), whereas tensile strength resists tension (being pulled apart). In the study of strength of materials, tensile strength, compressive strength, and shear strength can be analyzed independently.

The invention therefore relates to a process for the manufacture of paper wherein the process comprises a wet phase and a dry phase, wherein the wet phase comprises the steps of preparing a fibrous slurry comprising fibers in water, forming a fibrous web from the fibrous slurry by selectively removing the water, thereby obtaining a fibrous web containing 20 to 90 mass % of water, and wherein the dry phase comprises a step of drying the fibrous web to obtain a paper sheet comprising less than 20 mass % of water, wherein an additive is added during the wet phase, characterized in that the additive comprises enzymatically oxidized lignin.

It should be noted here that the method according to the invention utilizes enzymatically oxidized lignin, which is different from depolymerized lignin (Munk et al., Biotechnol. Adv. (2015) 33: 13-24). In chemical terms, oxidation is the reaction of taking out an electron from a molecule whereas depolymerisation is breaking a bond in a molecule. In other words, oxidation may result in some chemical modification but not necessarily breaking covalent bonds within the molecule. The breaking of covalent bonds in a molecule results in a reduction of the length of a molecule, which is depolymerisation.

Without wanting to be bound by theory, we hypothesize that enzymatically oxidized lignin is capable of better attaching itself to the paper structure whereas chemically oxidized lignin cannot. We show herein that enzymatic oxidation of lignin also results in polymerization of the lignin, in other words, the average molecular weight of the lignin increases (FIG. 1). In contrast, the chemical oxidation of lignin results in the depolymerisation of the lignin (PCT/SE2015/050970, PCT/SE2015/050969 and PCT/SE2017/050250).

In the examples as described herein, paper sheets were manufactured using a Rapid-KÖthen sheet former and paper was made using biorefinery lignin and Kraft lignin.

The term "biorefinery lignin" as used herein refers to lignin that is derived from a complex biomass utilization process. Biorefinery lignin has to be distinguished from pulp and paper lignin. It differs in at least two properties, namely pulp and paper lignin is highly chemically oxidized lignin and therefore its average molecular weight is lower than the average molecular weight of biorefinery lignin. Moreover, biorefinery lignin has more active groups (such as reactive hydroxyls, aldehyde, carboxylic acid) in comparison to pulp and paper derived lignin. This is mainly because biorefinery lignin is usually generated by milder processes compared to pulp and paper lignin.

As shown in the examples, we were able to produce paper with a high compressive index (also called compression index) which is the maximum force causing a compressive failure. Compression index was determined according to the TAPPI standard T826 Short span compressive strength of containerboard available at https://www.tappi.org/content/tag/sarg/t826.pdf.

In the exemplified processes, we added enzymatically oxidized lignin to the wet end of the papermaking process. We added the enzymatically oxidized lignin at two distinct moments during the wet phase; either in the very beginning of the process by mixing it with the slurry of fibers in water or by spraying it onto the semi-dry wet web (between 20-30 mass % water content). The compression index of the resulting papers was then determined.

We found that the compression index was increased by the addition of enzymatically oxidized lignin, to the paper made from biorefinery lignin as well as by its addition in the process of making paper from Kraft lignin. This effect could be observed for paper exposed to air of 50% relative humidity (table 1) as well as for paper exposed to air of 90% relative humidity (table 2).

The teaching as provided herein should not be construed so narrowly that it only relates to the exemplified quantities or concentrations of enzymatically oxidized lignin. We applied a wide range of different concentrations and quantities of enzymatically oxidized lignin species and found that although there are differences in the compressive index of the papers achieved, the invention works well over a broad range. The skilled person is well capable of performing concentration ranges in order to determine the optimal effect for a given experimental set-up. The same holds true for the type of fibers, pulp and different parameters applied in the process such as temperature and time, they all can be easily determined empirically using the guidance provided herein.

TABLE 1

Compression index of paper [Nm/g] at 50% relative humidity (in brackets, percent of no lignin control value is given, decimal comma's used).

| Additive comprises | Enzymatically oxidized lignin | Mode of application of lignin | |
|---|---|---|---|
| | | Spraying | Mixing |
| #1 No lignin (control) | NA | 23.1 (100%) | 23.1 (100%) |
| #2 Biorefinery lignin | – | 24.1 (104%) | 23.2 (100%) |
| #3 | + | 34.9 (151%) | 30.2 (131%) |
| #4 Kraft lignin | – | 23.2 (100%) | 23.1 (100%) |
| #5 | + | 27.1 (117%) | 25.5 (111%) |

TABLE 2

Compression index of paper [Nm/g] at 90% relative humidity (in brackets, percent of no lignin control value is given, decimal comma's used).

| Additive comprises | Enzymatically oxidized lignin | Mode of application of lignin: Spraying | Mode of application of lignin: Mixing |
|---|---|---|---|
| #1 No lignin (control) | NA | 16.2 (100%) | 16.2 (100%) |
| #2 Biorefinery lignin | – | 16.7 (103%) | 16.5 (102%) |
| #3 | + | 23.9 (148%) | 20.4 (126%) |
| #4 Kraft lignin | – | 16.3 (101%) | 16.2 (100%) |
| #5 | + | 18.1 (112%) | 17.9 (110%) |

Hence we concluded that the invention relates to a process for the manufacture of paper wherein the process comprises a wet phase and a dry phase, wherein the wet phase comprises the steps of preparing a fibrous slurry comprising fibers in water, forming a fibrous web from the fibrous slurry by selectively removing the water, thereby obtaining a fibrous web containing 20 to 90 mass % of water, and wherein the dry phase comprises a step of drying the fibrous web to obtain a paper sheet comprising less than 20 mass % of water, wherein an additive is added during the wet phase, characterized in that the additive comprises enzymatically oxidized lignin.

In a preferred embodiment, the invention relates to a process as described above, wherein the fibers are obtained from pulp. Fibers can be obtained by mechanical or chemical pulping and variations thereof. Non-limiting examples of the pulp types that may be used in the present invention are recycled fibers pulp (RCF), bleached or unbleached Kraft pulp, Neutral Sulfite Semi Chemical pulp (NSSC), thermomechanical pulp (TMP), wood pulp, hardwood pulp, softwood pulp, pulp obtained from old corrugated board, chemithermomechanical pulp (CTMP) or dissolving pulp.

In a further preferred embodiment, the fibers are selected from the group consisting of lignocellulose, cellulose, non-wood fibers and fibers from regenerated pulp.

In a further preferred embodiment, the invention relates to a process as described above, wherein the step of selectively removing the liquid is performed by spreading the fibrous slurry over a wire and draining the liquid.

In an even further preferred embodiment, the invention relates to a process as described herein, wherein the step of selectively removing the liquid is performed using gravitational force, centrifugal force, compressing or blotting.

The term "blotting" is used herein in its normal meaning as defined in Merriam Webster dictionary: namely to dry something with an absorbing agent or to remove water or fluid with an absorbing material.

In a further preferred embodiment, the invention relates to a process as described herein, wherein enzymatically oxidized lignin is obtained by contacting lignin with an oxidizing enzyme selected from group of peroxidases, laccases and alkaline laccases, such as a cotA laccase.

In a further preferred embodiment, the invention relates to a process as described herein, wherein the oxidized lignin is size separated.

In a further preferred embodiment, the oxidized lignin is depleted of lignin molecules with a molecular weight below 2 kDa, preferably below 5 kDa, such as 10 kDa, 20 kDa, 50 kDa or 70 kDa. The term "depleted" is used herein to indicate that molecules below a certain molecular weight are diminished in number or quantity. This can be achieve by selectively removing molecules below a certain molecular weight.

The phrase "selectively removed" is used herein to indicate that the fraction of lignin molecules with a low molecular weight is removed from the reaction mixture to a larger extent than at least some of the lignin molecules with a higher molecular weight.

Figure 2:
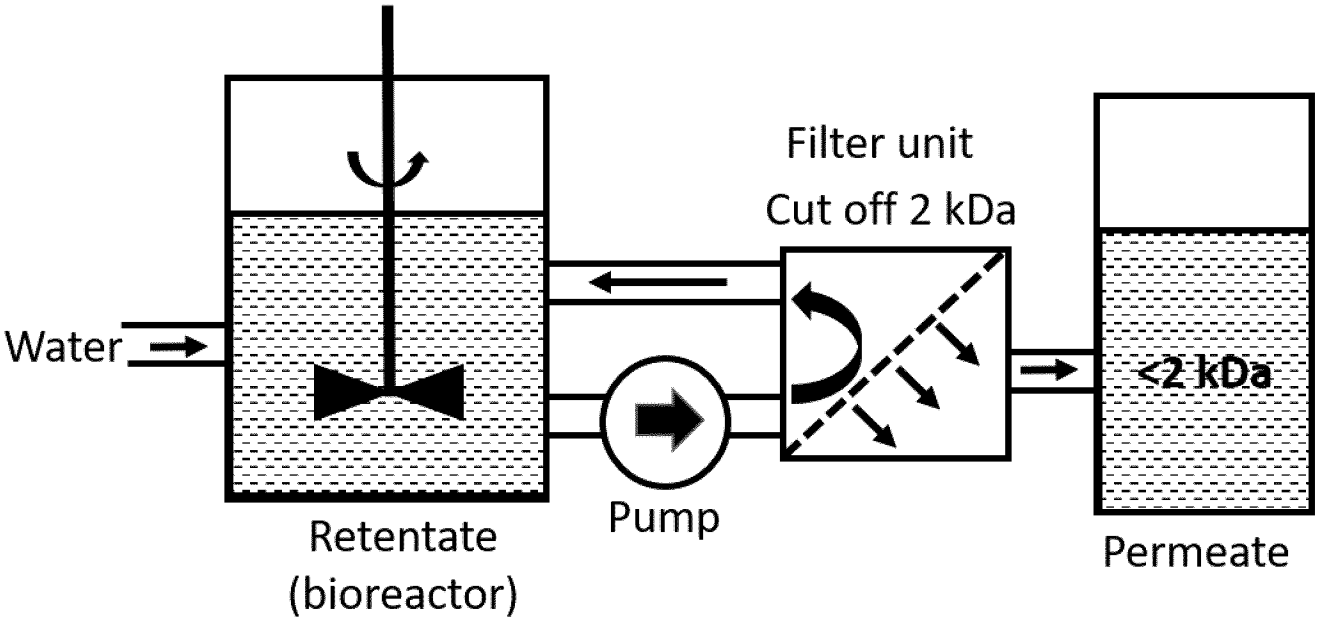
FIG. 2 depicts a schematic overview of a twin-pot bioreactor for continuous filtration, allowing for the reaction mixture to be continuously circulated through a tangential flow membrane unit with 2 kDa cut-off value.

The phrase "selectively removed from the reaction vessel during the reaction" relates to a method wherein the reaction between the laccase and the lignin is ongoing, while at least part of the low molecular weight lignin fraction is removed from the reaction vessel. The skilled person is familiar with techniques how this may be achieved, such as for example by ultrafiltration in a fed-batch reactor or a continuous flow reactor (FIG. 2).

Even more surprising, it was found that the method as described above could be improved when the additive comprises a fatty acid. This resulted in an even higher compressive strength as compared to an additive comprising enzymatically oxidized lignin without the fatty acid (table 3).

TABLE 3

Compression index of paper [Nm/g] at 90% relative humidity sized with a variety of enzymatically oxidized lignin compositions, (in brackets, percent of no lignin control value is given).

| Additive comprises | Mode of application of lignin: Spraying | Mode of application of lignin: Mixing |
|---|---|---|
| #1 No lignin (control) | 16.2 (100%) | 16.2 (100%) |
| #3 Enzymatically oxidized biorefinery lignin | 23.9 (148%) | 20.4 (126%) |
| #6 Enzymatically oxidized biorefinery lignin plus stearic acid | 25.5 (157%) | 24.3 (150%) |
| #7 Enzymatically oxidized biorefinery lignin depleted of lignin molecules with a molecular weight below 2 kDa molecular weight. | 25.1 (155%) | 24.5 (151%) |

The invention also relates to paper obtainable by the process as described herein, characterised in that the paper comprises enzymatically oxidized lignin and has a compression index above 25 Nm/g when incubated for 16 hours at 22 degrees Celsius at 50% relative humidity or above 17 Nm/g when incubated for 16 hours at 22 degrees Celsius at 90% relative humidity.

The invention also relates to a composition comprising an enzymatically oxidized lignin depleted of lignin molecules with a molecular weight below 2 kDa (table 3), preferably below 5 kDa. Furthermore, the compressive strength of the paper obtained in the method as described above could be even further improved by using lignin depleted of fragments with a molecular weight below 10 kDa, 30 kDa, 50 kDa or 70 kDa.

The invention also provides the use of a composition as described above as an additive in a papermaking process for increasing the compressive strength of paper obtained in said papermaking process.

EXAMPLES

Example 1: Preparation of Alkaline Laccase

Alkaline laccase for the enzymatic oxidation of lignin was prepared using methods known in the art (VVO 2018/019707, Hämäläinen et al., Front. Bioeng. Biotechnol, 6:20 doi: 10.3389/fbioe.2018.00020 (2018)).

Specific enzyme activity of the laccase was determined using ABTS as a substrate. Reaction mixture was prepared by mixing 20 ul of diluted enzyme with 430 microliter of 100 mM Sodium Acetate pH 4.5 in 1-cm-light-path spectrophotometer cuvette, the mixture was equilibrated to 60 degrees Celsius (C); the reaction was initiated by adding 50 ul of ABTS solution and incubated at 60 degrees C. UV measurements at 405 nm were performed every 2 min. One unit of laccase activity was defined as the amount of enzyme oxidizing 1 micro mole of ABTS per minute under these conditions, wherein the extinction coefficient of ABTS at 405 nm is 36800 $M^{-1}$ $cm^{-1}$). Enzyme activity may also be expressed as katals, wherein one microkatal is the amount of enzyme oxidizing 1 micromole of substrate per second, hence 1 microkatal equals 60 units.

Example 2: Preparation of Enzymatically Oxidized Lignin

Biorefinery lignin was obtained from an industrial source (Sweetwater Inc.). Alkali-soluble lignin was prepared as follows: Lignin was solubilized at 100 g/l in 0.25 M NaOH, mixed for 30 minutes at room temperature, centrifuged at 6000 g for 20 minutes and the supernatant was dried in oven at 105 degrees C. and stored at room temperature until used. The dried alkaline-soluble lignin was then dissolved to completion at 50 g/I in water and pH adjusted to 10.5. The molecular weight distribution of this alkali-soluble lignin fraction is depicted in FIG. 1, t=0.

Alkali-soluble lignin prepared as described above was dissolved in 750 ml water to the final concentration of 50 g/L to obtain a lignin solution. The enzymatic oxidation reaction was run in 1 L twin-pot bioreactor (BIOSTAT® B plus twin from Sartorius Stedim Biotech). The reactor with lignin solution was equilibrated to 50 degrees C., and pH 10.5 with aeration at a rate of 0.16 l/min. After that, the enzyme was added to an amount of 800 nkatal/gram of lignin (~50 U/gram of lignin). The reaction was continued for 5 hours (h) with constant aeration at a rate of 0.16 l/min. Dissolved oxygen level was maintained at a constant level from the time of enzyme addition and the pH was controlled with NaOH to remain at 10.5 throughout the reaction. Total time of the process was 5 hours. Samples after 1 h and after 5 h were collected and analyzed by size exclusion chromatography (FIG. 1, t=1 h and t=5 h). All samples were diluted with 0.1M NaOH for HPLC injection.

Example 3: Preparation of Enzymatically Oxidized Lignin Depleted of Lignin Molecules with a Molecular Weight Below 2 kDa Alkali-soluble lignin prepared as described above was dissolved in 750 ml water to the final concentration of 50 g/L to obtain a lignin solution. The reaction was run in 1 L twin-pot bioreactor (BIOSTAT® B plus twin from Sartorius Stedim Biotech). The reactor with lignin solution was equilibrated to 50 degrees C., and pH 10.5 with aeration at a rate of 0.16 l/min. After that, the enzyme was added to an amount of 800 nkatal/gram of lignin (~50 U/gram of lignin). The reaction was continued for 1 h in a batch mode with constant aeration at a rate of 0.16 l/min. Dissolved oxygen level was maintained at a constant level from the time of enzyme addition and the pH was controlled with NaOH to remain at 10.5 throughout the reaction. After one hour, the reaction was switched to continuous filtration mode (FIG. 2) for 4 hours (thus total reaction time was 5 h). The reaction mixture was continuously circulated through a tangential flow membrane unit Vivaflow 200 (Sartorius) with polyethersulfone membranes with 2 kDa cut-off value. The filtration unit was used according to the manufacturer's protocol (2.5 bar pressure, 200-400 ml/min retentate flow/module). While the reaction was circulated through the filtration unit, the reaction conditions (pH and temperature) were maintained in the reactor and the reaction mixture was replenished with water to keep the volume in the reactor constant. The permeate accumulation rate was approximately 2 L/h, thus the whole reaction volume was replaced in approximately 20 min. Samples were analyzed by HPLC.

To normalize the volumes of different fractions (starting material, retentate and permeate) for HPLC analysis, retentate sample was used undiluted, permeate sample was diluted with water 1:0.1, starting material sample was diluted with water 1:10.6.

Example 4: Size Exclusion HPLC

All samples were further diluted with 0.1M NaOH for HPLC injection.

Size exclusion chromatography for lignin samples and molecular weight standards was performed using HPLC chromatographer 120 Compact LC with UV detector (Agilent Technologies), equipped with size exclusion column MCX 1000 Angstrom 5 μm, 8×300 mm and with pre-column MCX 5 μm, 8×50 mm (Polymer Standards Service). Isocratic mode with 0.1M NaOH eluent flow 0.5 ml/min at room temperature was used; run time was 40 min. The detection was performed at 358 nm. Molecular mass standards (polystyrene sulfonate sodium salt standards Mp=~0.9 to ~65 kDa, Polymer Standards Service) were monitored at 254 nm. Data were acquired with EzChrom Elite Compact software.

Primary HPLC traces acquired with Agilent EZChrom Elite software were transferred to tailor-made MS Excel spreadsheets for further processing. Signal versus retention time graphs were produced from 1 Hz time series to depict the chromatography traces.

Polystyren sulfonate Molecular mass standards (Polymer Standards Service), ranging in mass at peak maximum from MW=~900 to ~65000, and syringaldehyde (MW 182) were used for calibration of molecular weights.

Based on HPLC profiles, the weight average molecular weight (Mw) values were calculated for lignin fractions.

The Mw was calculated using the equation:

$$Mw = \frac{\Sigma(WiMi)}{W} = \frac{\Sigma(HiMi)}{\Sigma Hi}$$

wherein W is the total weight of polymers, WI is the weight of i-th polymer, Mi is the molecular weight of the i-th elution time and Hi is the height of i-th elution time.

Example 5: Preparation of Additives for Paper Making Process

Additives for paper making were prepared or obtained as follows:

Sample 1: No lignin control: water, no additives.

Sample 2: Biorefinery lignin, no enzyme treatment: lignin as prepared in example 2, but no enzyme added to the reactor; lignin concentration 50 gram/liter pH adjusted to 10.5 with NaOH.

Sample 3: Biorefinery lignin, enzyme treated lignin as prepared in example 2; lignin concentration 50 gram/liter pH adjusted to 10.5 with NaOH.

Sample 4: Kraft lignin; Purchased from Sigma Aldrich, lignin concentration 50 gram/liter pH adjusted to 10.5 with NaOH.

Sample 5: Enzymatically oxidized Kraft lignin; Purchased from Sigma Aldrich, enzyme treated as described in example 2, lignin concentration 50 gram/liter, pH adjusted to 10.5 with NaOH.

Sample 6: Enzymatically oxidized biorefinery lignin plus stearic acid. This was prepared by adding 2.8 g of stearic acid to 200 ml of lignin solution (50 gram lignin/liter). The stearic acid was allowed to melt at 90° C. for 20 min. The solution was then homogenized in a blender for 5 min.

Sample 7: Enzymatically oxidized biorefinery lignin depleted of lignin molecules with a molecular weight below 2 kDa molecular weight prepared as described in example 3, FIG. 2; lignin concentration in the final sample was adjusted to 50 gram/liter, pH adjusted to 10.5 with NaOH.

Example 6: Preparing Paper Sheets by Mixing Additives in the Wet Phase

Hundred and sixty three grams of old corrugated cardboard (OCC) with a water content of about 8% was immersed in water to a total weight of 3000 g, mixed for 15 min and let rest overnight. The material obtained after overnight soaking was aliquoted to 600 g batches that were diluted to 2000 g and subsequently disintegrated with an IDMtest disintegrator according to the manufacturer's instructions to obtain a fibrous slurry.

This fibrous slurry was diluted to 9400 g with water and 600 ml of additive or water (control) was added (this is referred to as "mixing" in tables 1-3). The fibrous slurry was stirred continuously for at least 10 minutes until used. Thousand gram of this fibrous slurry was then fed into a Rapid-KÖthen sheet former in order to eventually produce one paper sheet with a surface area of 314.15 $cm^2$ (disc with a diameter of 20 cm) according to the manufacturer's instructions.

A wet sheet of paper or a semi-dry sheet of paper in this stage of production is also often referred to as a fibrous web or a semi-dry fibrous web. The thus obtained fibrous web was then dried between two sheets of blotting paper at each side and pressed with a Lorentzen & Wettre sheet press for 2 minutes, using a pressure of 2 bar. The fibrous web was then covered with a blotting paper again and dried in the Rapid-KÖthen sheet formers drying section according to the manufacturer's instructions. The fibrous web was then heated in a Binder laboratory oven for 60 min at a temperature of 105° C.

Example 7: Preparing Paper Sheets by Spraying an Additive in the Wet Phase

Hundred and sixty three grams of old corrugated cardboard (OCC) with a water content of about 8% was immersed in water to a total weight of 3000 g, mixed for 15 min and let rest overnight. The material obtained after overnight soaking was aliquoted to 600 g batches that were diluted to 2000 g and subsequently disintegrated with an IDMtest disintegrator according to the manufacturer's instructions to obtain a fibrous slurry.

This fibrous slurry was diluted to 10 kg with water. Thousand gram of this fibrous slurry was then fed into a Rapid-KÖthen sheet former in order to eventually produce one paper sheet with a surface area of 314.15 $cm^2$ (disc with a diameter of 20 cm) according to the manufacturer's instructions.

A wet sheet of paper or a semi-dry sheet of paper in this stage of production is also often referred to as a fibrous web or a semi-dry fibrous web. The thus obtained fibrous web was then taken out of the Rapid-KÖthen sheet former and placed between two sheets of blotting paper at each side. Next, the fibrous web was pressed with a Lorentzen & Wettre sheet press for 2 minutes, using a pressure of 2 bar.

The resulting fibrous web was then sprayed with 4 ml of the additive or with an equal volume of water as a control, in a spraying chamber using a spray gun (this is referred to as "spraying" in tables 1-3.

The fibrous web was then covered with a blotting paper again and dried in the Rapid-KÖthen sheet formers drying section according to the manufacturer's instructions. The fibrous web was then heated in a Binder laboratory oven for 60 min at a temperature of 105° C.

Example 8: Testing of the Compression Strength of Paper

The dry weight of the dry fibrous web obtained in the previous examples was determined and the grammage of the paper was calculated. Two strips of 15 mm width were cut and placed in the climate chamber at 50% or 90% relative humidity and incubated at 22 degrees C. for 16 hours. The paper strips were then taken out of the climate chamber and immediately placed between the clamps of an IDMtest SCT TS compressor PTA. The Compression Index (maximum force causing a compressive failure) was determined according to the TAPPI standard T826 Short span compressive strength of containerboard (https://www.tappi.org/content/tag/sarg/t826.pdf). Ten tests were performed for each condition, using ten independently produced sheets. Average values were calculated and presented herein in the above tables 1-3. Standard deviations were found to be within a 5% range.

As used herein, CS is the Compressive Strength or the maximum force needed to have a compressive failure in the test piece (unit is N/m), whereas CI or Compression Index is taking into account the grammage of the paper so it expresses CS normalized according to the grammage (unit Nm/g or kNm/kg). Therefore, CI equals CS divided by the grammage of the test piece ($g/m^2$).

The invention claimed is:

1. A process for the manufacture of paper wherein the process comprises a wet phase and a dry phase, wherein the wet phase comprises the steps of:

a) preparing a fibrous slurry comprising fibers in water, wherein the fibers are selected from the group consisting of fibers comprising lignocellulose, hemicellulose and cellulose, b) forming a fibrous web from the fibrous slurry by selectively removing the water, thereby obtaining a fibrous web containing 20 to 90 mass % of water, and wherein the dry phase comprises a step of drying the fibrous web to obtain a paper sheet comprising less than 20 mass % of water, wherein an additive is added during the wet phase, characterized in that the additive comprises enzymatically oxidized lignin wherein the enzymatically oxidized lignin is depleted of lignin with a molecular weight below 2 kDa.

2. The process according to claim 1 wherein the fibers are obtained from pulp.

3. The process according to claim 2 wherein the pulp is selected from the group consisting of recycled fibers pulp (RCF), bleached or unbleached Kraft pulp, Neutral Sulfite Semi Chemical pulp (NSSC), thermo-mechanical pulp (TMP), wood pulp, hardwood pulp, softwood pulp, pulp obtained from old corrugated board, chemithermomechanical pulp (CTMP) and dissolving pulp.

4. The process according to claim 1 wherein the step of selectively removing the liquid is performed by spreading the fibrous slurry over a wire and draining the liquid.

5. The process according to claim 1 wherein the step of selectively removing the liquid is performed using gravitational force, centrifugal force, compressing or blotting.

6. The process according to claim 1 wherein enzymatically oxidized lignin is obtained by contacting lignin with an oxidizing enzyme selected from group of peroxidases, laccases and alkaline laccases.

7. The process according to claim 6 wherein the oxidizing enzyme is a cotA laccase.

8. The process according to claim 1 wherein the additive additionally comprises a fatty acid.

9. The process according to claim 8, wherein the fatty acid is stearic acid.

10. Paper obtainable by the process of claim 1 characterized in that the paper comprises enzymatically oxidized lignin depleted of lignin with a molecular weight below 2 kDa.

* * * * *